United States Patent [19]

Teron

[11] Patent Number: 4,907,910

[45] Date of Patent: Mar. 13, 1990

[54] ROOF STRUCTURE FOR TUNNEL

[75] Inventor: William Teron, Ottawa, Canada

[73] Assignee: Teron International Development Corporation Ltd., Ottawa, Canada

[21] Appl. No.: 174,310

[22] Filed: Mar. 28, 1988

[30] Foreign Application Priority Data

Mar. 27, 1987 [CA] Canada ..... 533161

[51] Int. Cl.[4] ..... E21F 1/00; F21D 10/04; F21D 11/04

[52] U.S. Cl. ..... 405/132; 405/149; 52/220; 52/302; 52/236.9; 98/29; 98/49

[58] Field of Search ..... 405/43, 45, 124–126, 405/132, 134, 146, 149–151; 52/79.3, 79.14, 169.6, 220, 263, 302, 469; 98/29, 31, 49

[56] References Cited

U.S. PATENT DOCUMENTS

| | | | |
|---|---|---|---|
| 528,496 | 10/1894 | Williams | 98/49 X |
| 1,643,868 | 9/1927 | Woll | 98/49 X |
| 2,031,631 | 2/1936 | Bemis | 52/220 |
| 2,427,075 | 9/1947 | Singstad et al. | 98/49 |
| 3,415,024 | 12/1968 | Kotlarz | 98/31 X |
| 3,742,674 | 7/1973 | Lang | 52/220 X |
| 3,835,606 | 9/1974 | Liberman | 52/220 |
| 3,983,671 | 10/1976 | Boaden et al. | 52/220 |
| 4,589,330 | 5/1986 | Teron | 98/31 |

FOREIGN PATENT DOCUMENTS

| | | | |
|---|---|---|---|
| 384173 | 1/1965 | Switzerland | 98/31 |

*Primary Examiner*—Dennis L. Taylor
*Assistant Examiner*—John A. Ricci
*Attorney, Agent, or Firm*—Pascal & Associates

[57] ABSTRACT

A long tunnel structure for covering a depressed highway or railway, which provides substantially increased ventilation and over which parkland or building structures can be built. In the latter case the columns of the tunnel structure can be used as columns for supporting the building. The tunnel structure is comprised of support structures for roof beams, and a plurality of parallel roof beams supported by the support structures extending laterally over the depressed highway. Each of the roof beams is comprised of an elongated slab and a pair of spaced elongated upwardly projecting slab legs each spaced from longer edges of the slab and extending along the slab. The slabs are spaced apart a distance sufficient to allow air flow therebetween. Elongated closure slabs are disposed over the ends of the legs of adjacent slabs along the beams to form vents between adjacent legs of adjacent beams.

20 Claims, 8 Drawing Sheets

Figure 2:
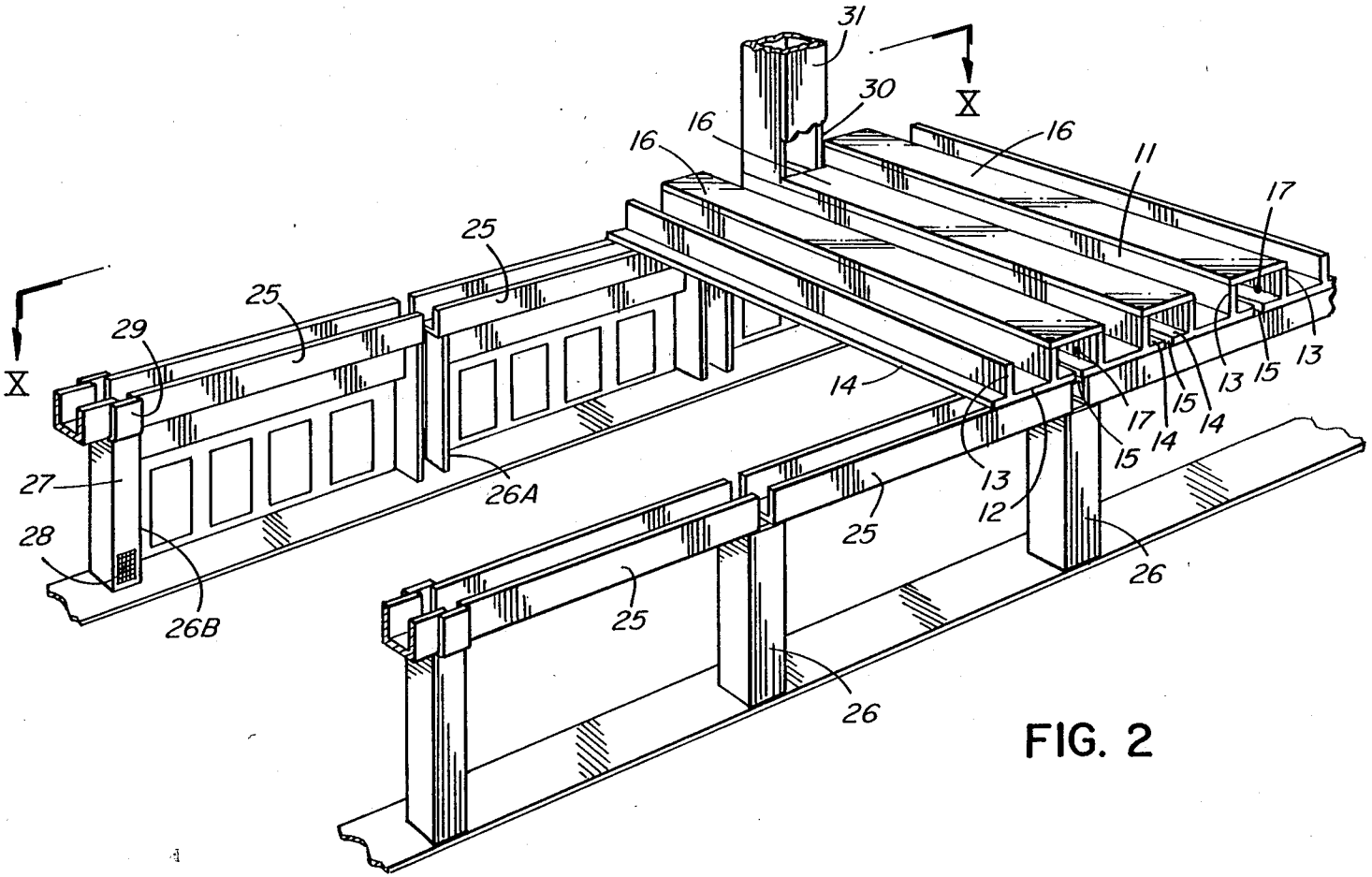

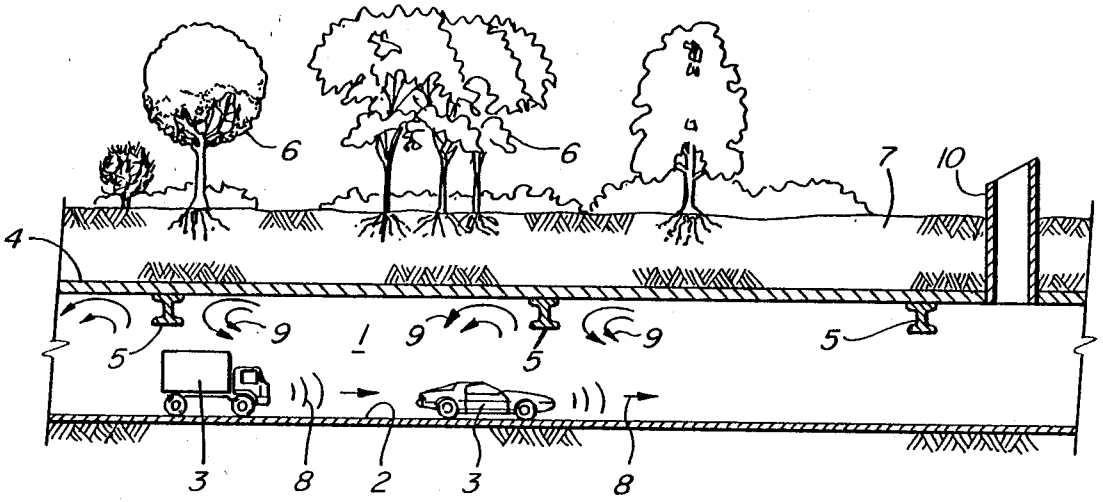
FIG. IB
PRIOR ART
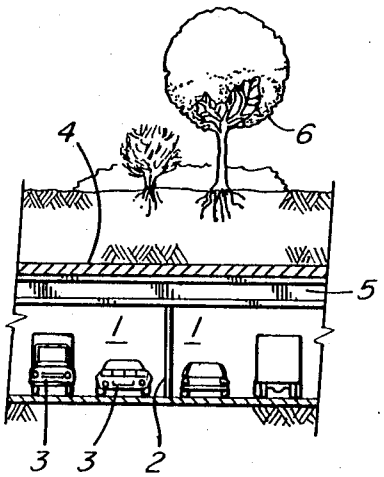
FIG. IA
PRIOR ART

ROOF STRUCTURE FOR TUNNEL

This invention relates to a tunnel structure and particularly to a structure for covering a depressed highway or railway in order to create a tunnel and/or to enclose or build over a highway, railway, etc. at the surface.

A depressed highway or railway is formed by cutting a channel into the ground and constructing a highway or railway track along the bottom of the channel. Depressed highways or railways (both referred to below as depressed highways) are sometimes built in heavily urbanized areas for carrying heavy, noisy traffic. The depression of the highway substantially reduces the noise of the traffic at the grade level alongside the highway due to the sidewalls which contain the traffic sounds. The construction of such a highway is usually considerably less expensive than construction of a tunnel. Crossroads can be bridged over the depressed highway at grade level, thereby minimizing the cost of bridging.

However it has been found that a depressed highway causes a significant problem. The depressed highway forms a gash in the urban region, severely separating the urban areas on each side. Since the urban areas on each side are typically joined only at the crossroads, which often carry heavy traffic, it has been found to be difficult and sometimes dangerous for pedestrian traffic to cross from the urban area on one side to the urban area on the other side of the depressed highway. The depressed highway also forms a visual scar, and has been found to limit access of facilities such as parks, etc. existing on one side of the depressed highway to pedestrians on the other side.

The problems are compounded if the highway exists at grade. Not only is the traffic noise high, pedestrians cannot cross except where expensive pedestrian or vehicular bridges are built or at highway interchanges.

Downtown expressways have been found to be an urban blight that negatively affect the overall quality of a total city. Placing the expressway underground allows the city to create new land, new planning and a new urban environment. The positive impact on the entire civic atmosphere can be enormous, improving the quality of life and the value of property. When the urban core happens to be next to a waterfront or a park, the potential of joining these areas to the city is a major added advantage.

Enclosing these expressways in a sub-surface tunnel roadway is the ideal way of eliminating the noise, the air pollution and the negative aesthetics. Sub-surface expressways permit level crossings without costly and land-hungry overpasses. There are sub-surface expressways which are not covered, such as the Decarie Boulevard and the Place de Ville expressways in Montreal, Quebec, Canada, or the Peripherique in Paris, France. These depressed expressways created crossings at grade level, but the noise, the air pollution and the ugly aesthetics are still present.

However covering a depressed highway involves constructing long bridges which can be prohibitively expensive, and introduces several problems, some of which are particular to tunnels. One such problem involves the expulsion of air pollutants such as carbon monoxide.

Tunnel categories are normally referred to by three levels of ventilation standards. Short, naturally ventilated tunnels; medium length tunnels which are partially ventilated, with so-called semi-transverse ventilation systems; and long tunnels (e.g. over 1,000 meters) which require full mechanical ventilation, called fully transverse ventilating systems. Ventilation systems for tunnels of various lengths are described in the 1982 Applications Handbook, Chapter 13, Enclosed Vehicular Facilities, pp. 13.1–13.7 to which the reader is referred.

Short tunnels are naturally ventilated, open to both directions of traffic within one tunnel, and the ventilation is assisted by the piston action of the moving vehicles.

Medium length tunnels are naturally ventilated. Each of a pair of tunnels is separated so that traffic in each tunnel passes in one direction only, and the piston action of the traffic is assisted by fans pushing air in and out of the tunnel to large roof openings midway in the tunnel.

Long tunnels require full mechanical ventilation, evenly distributed in the tunnel. Fresh air is supplied at the floor near vehicle exhaust emissions for maximum dilution effect. The foul exhaust air is extracted at the ceiling. Sufficient quantity of air must be provided for fire conditions and safety of people during such a crisis. There must be methods to detect and manage the hazards of fire or carbon monoxide and methods to communicate with people in the tunnel.

The above requirements for long tunnels are very difficult to accomplish because evenly distributed ductwork, no more than 10 meters apart, must be accommodated within the construction of the tunnel. The normal solution is to either build a third tunnel between the two vehicular tunnels to provide the ventilation requirements, or to build a double concrete roof and wall system to accommodate the ductwork system. The surface within the tunnel must be extremely durable to withstand the corrosive effect of decades of very destruction emissions therefore a costly double concrete structure is used.

Where tunnels are bored through the earth, the tunnel walls are usually made smooth in order to allow the air to pass along the walls with minimum friction. However where a depressed highway is to be covered, usually bridging techniques are used, with cross-beams for supporting the roof passing from one side to the other of the highway. Such cross-beams interrupt the flow of air and cause turbulence, which interferes substantially with the smooth passage of air. Consequently the ventilation problem is compounded. Long tunnels in particular require evenly distributed ventilation, which is not possible in the presence of turbulence.

If an attempt is made to hang a smooth ceiling between cross-beams of the bridging structure in order to reduce the air turbulence, the tunnel ceiling is as a result lowered, which can increase the driving danger in the covered depressed highway due to accumulation of noxious corrosive gases. If a double roof and walls system is used to obtain durability, the expense is increased substantially, and the tunnel ceiling is made still lower.

In order to build a bridging structure over a depressed highway, scaffolding must be used, which results in closure of the highway and thus disruption of traffic during the construction period. In order to maintain safety the highway must be cut deeper.

If the bridge structure is to be covered with soil, for example to form a park, the entire upper surface of the bridge must be paved in order that ground water should not leak through and form streams into the lanes of traffic. If trees are to be planted, the soil depth over the bridge must be sufficiently great to contain tree roots. In addition the bridge roof structure must have sufficient strength to withstand the weight of the earth, trees, etc.

If a substantial depth of topsoil is to be used in order to accommodate tree roots and at the same time if it is desired to avoid the creation of an elongated hill above the covered highway by maintaining the grade surface above the topsoil at the same level or not substantially above the grade on either side of the highway, the depressed highway must be cut still deeper. Thus to unify the urban areas on both sides of the highway the resulting cost and complexity of the depressed highway is substantially increased.

The present invention is a structure for forming a long tunnel out of a depressed highway or indeed a highway at the surface, which substantially eases the above described problems. The structure presents smooth surfaces to the interior of the resulting tunnel, substantially reducing the turbulence which would be caused by exposed cross-beams. While typically ventilation ducts are distributed at 10 meter intervals, they are located at typically 3 meter intervals in the present invention. This results in ventilation capacity far in excess of normal standards, resulting in healthier air and reduced corrosive gas buildup. All ducts are concrete, including concrete structural beams which double as the major supply and exhaust ducts. No metal which can corrode is used for any of the air distribution system.

The single tunnel roof structure also accommodates with itself space for pipe transfers etc. for municipal services and for accommodating buildings to be built above it. The same space can be used to accommodate both drainage and earth of a sufficient depth to permit parkland landscaping and construction.

The single tunnel roof structure which incorporates infrastructure within itself provides a low profile solution which substantially reduces the overall height of a fully transverse tunnel structure, thus avoiding the requirement of cutting the highway deeper.

A smooth epoxy ceiling surface is preferred to be used to facilitate air flow and to reduce the accumulation of residue from fuel emissions. The total interior of the tunnel allows for cleaning all surfaces by a high pressure water truck.

Only a single layer construction is required with no separate ventilation or other ductwork.

The single pre-cast wall system used in one embodiment of the invention provides evenly distributed fresh air at the exhaust pipe level of vehicles, at both sides of the tunnel and in the middle of the tunnel, for greater dilution of exhaust emissions. Fresh air ducts are continuous and of a size which double as exits and evacuation corridors.

The structure provides corridors for lighting and essential services, and also allows maintenance without personnel having to enter the tunnel environment.

The structure is totally pre-cast, permitting construction of tunnels over existing roadways without closing roads to traffic. Pre-cast work is done off-site. Erection can be done at low traffic periods during the night when the number of lanes can be reduced allowing this work to be done. Scaffolding and formwork on site are totally eliminated.

The present invention is matched to work with a dual long span building structure designated to create buildings over these expressway tunnels at costs which makes both enterprises economically viable.

The structure allows substantial depth of soil above the roof of the depressed highway sufficient to allow the roots of large trees to grow. Yet the overall depth between the top of the topsoil and the ceiling surface of the depressed highway cover is substantially less than was previously required, and it is so shallow that a typical depressed highway need not be dug deeper than already exists. Yet the top of the topsoil covering the depressed highway will not be substantially higher in a typical installation than the grade level on either side of the depressed highway. The above invention thus allows unification of the urban area on one side of the depressed highway with, for example, parkland on the other side, allowing pedestrian traffic to pass unimpeded from one side to the other, and eliminating the sight and sound of the depressed highway.

Because the soil depth above the roof of the highway can be substantially shallower than required by the use of prior art techniques, the ceiling height above the highway can be increased, thus maintaining an adequate safety standard. With shallower soil depth, the weight that the roof must support is reduced, reducing the required strength and weight of the roof members and columns which support the roof members.

Further, the present invention can be used to cover highways at surface level to form tunnels which can be covered with buildings and/or fill and topsoil to form parkland, which can unify the parts of the urban area on both sides of the highways. In the latter case judicious landscaping can virtually eliminate the appearance of a long monolithic hill covering the highway.

The structural elements used to roof the highway and to support the highway roof are prestressed concrete beams of a particular form and orientation, which inherently provide air ventilation channels while at the same time form the roof for the depressed highway.

The present structure has also been found to substantially reduce the cost of covering such a highway over prior structures.

Due to the nature of the structure, in an embodiment of the present invention the beams used to support the roof for the covered highway can also be extended upwardly to form the structure of a building. Thus not only can parkland be provided in the area above the highway joining the urban areas on both sides of the depressed highway, but in addition valuable commercial buildings can be built above.

The above structure is provided in one embodiment of the invention which is a tunnel structure comprising support structure along both sides of a highway and a plurality of parallel roof beams supported by the support structure extending laterally over the highway. Each of the roof beams is comprised of an elongated slab and a pair of spaced elongated upwardly projecting slab legs, each leg being spaced from an adjacent long edge of the slab and extending along the slab. The elongated slabs are spaced apart a distance sufficient to allow air flow between them. An elongated closure slab is disposed over the tops of the legs of adjacent slabs along the beams to form a vent between adjacent legs of adjacent beams. The bottom surface of the elongated slabs form the ceiling of the formed tunnel.

The support structure for the roof beams is disposed along the depressed highway and the roof beams are disposed across. Thus air forced through the resulting tunnel by automotive traffic or ventilation fans can pass into the gaps between the adjacent legs of adjacent slabs and into the vent. Since the gaps are spaced at distances equal to the width of the roof beams, e.g. 3 meters, there is substantial tunnel pressure relief by air flow into the vents.

The vents communicate with vents which are integral with the support structure along the sides of the highway, which in turn communicate with vents extending to the grade surface. Other elongated vents along the highway at the lower levels communicate with vents at grade surface, which introduce fresh air into the tunnel.

The space between the upwardly extending legs of the roof beams can be filled with the required topsoil. Thus the ends of the beam legs can extend much closer to the soil grade surface than would otherwise be expected; yet the roots of large trees can extend downwardly to the required depth between the legs of the beams. This allows the grade surface of the topsoil to be much lower than previously was possible using prior art structures.

Figure 3:
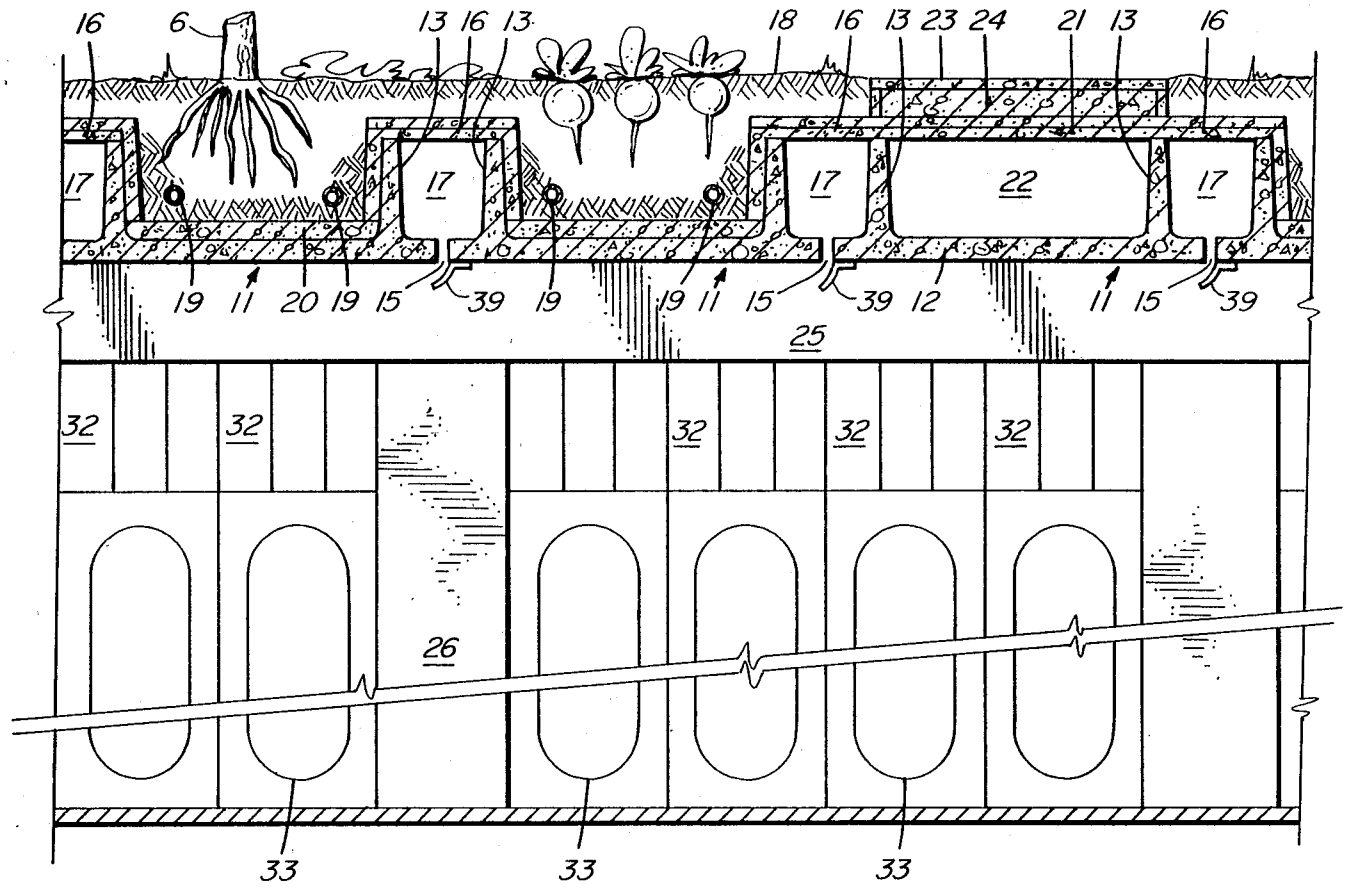
Figure 4:
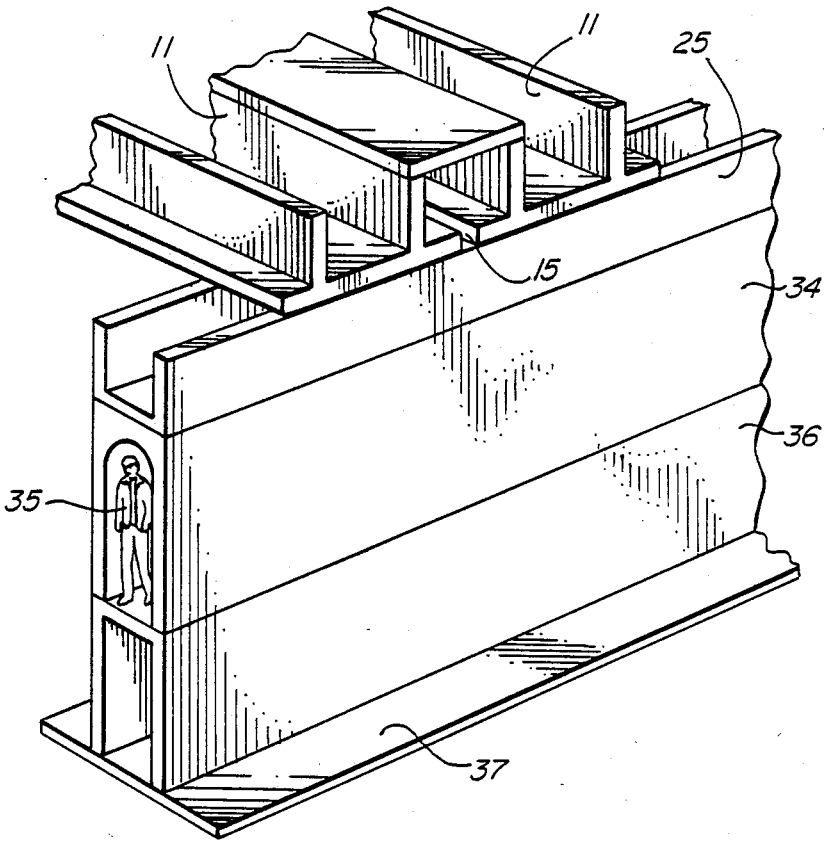
Figure 5:
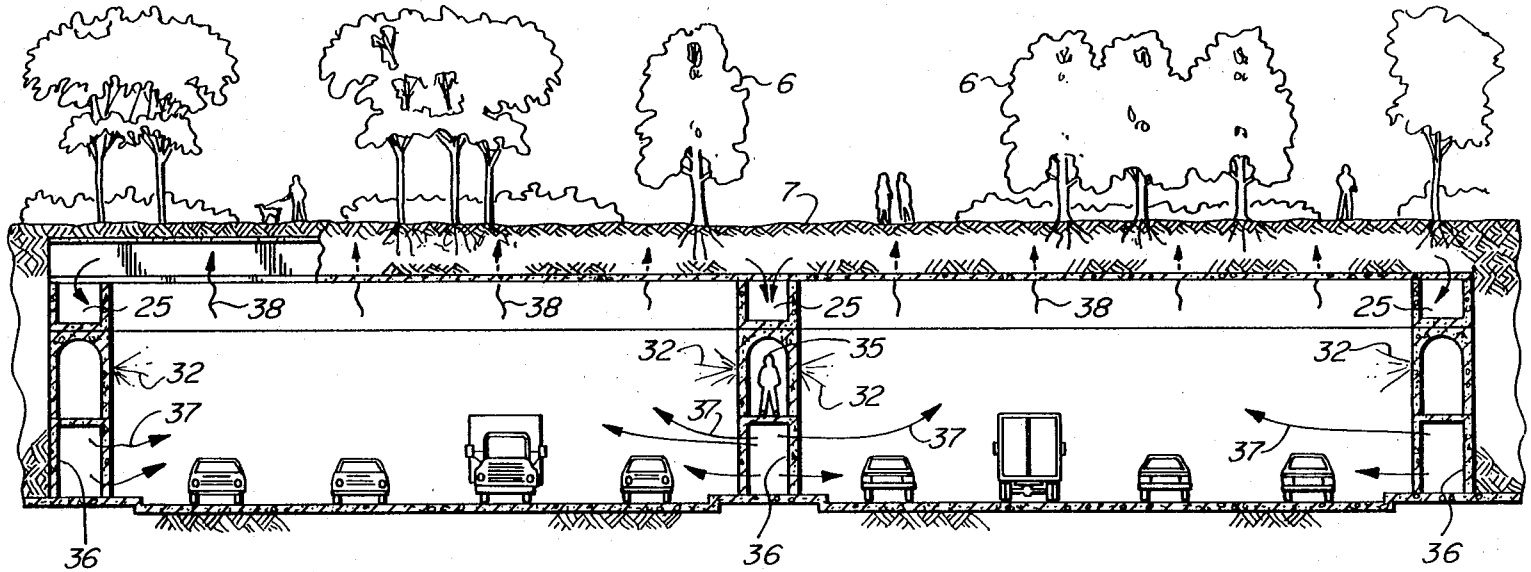
Figure 6:
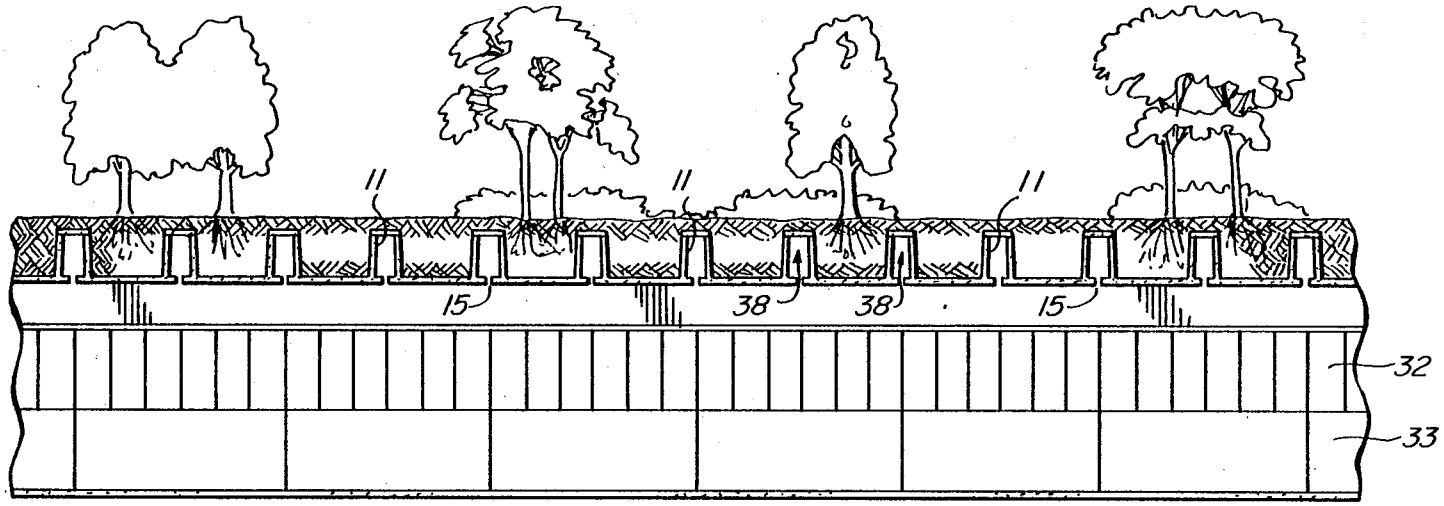
Figure 7:
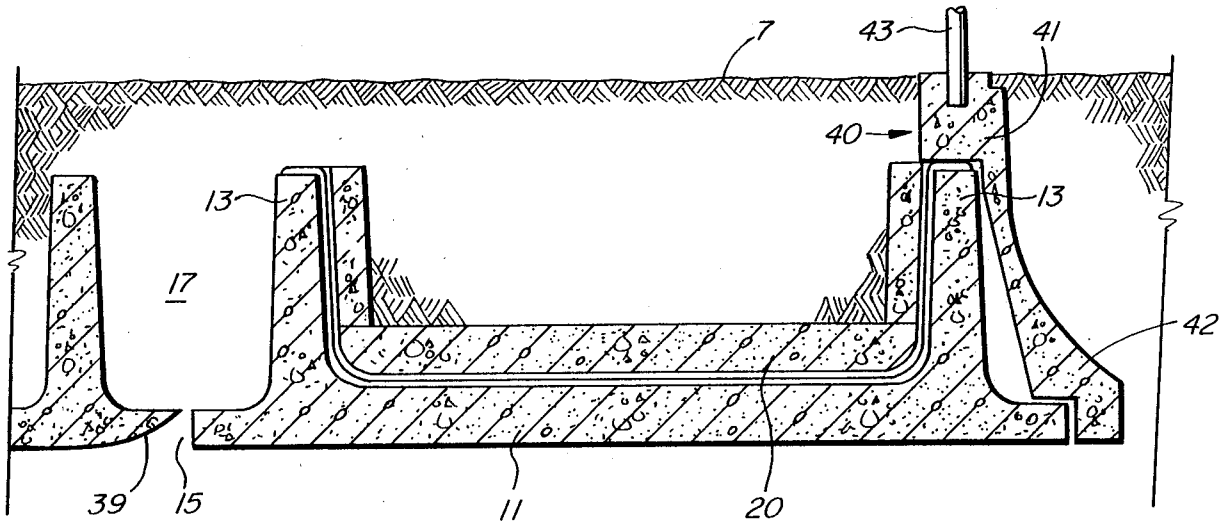
Figure 8:
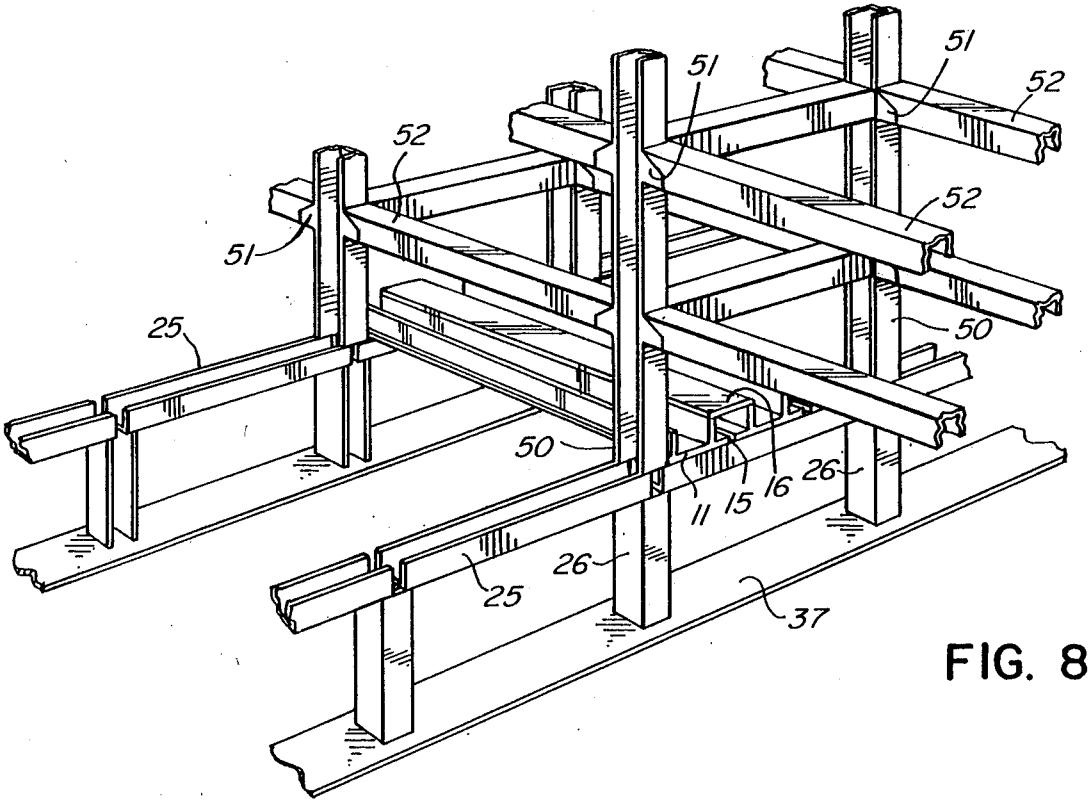

A better understanding of the invention will be obtained by reference to the description of a preferred embodiment below, with reference to the following drawings in which:

FIGS. 1A and 1B are respectively axial and lateral sectional schematic views of a tunnel for a depressed highway in accordance with the prior art, FIG. 2 is an isometric view showing details of a first embodiment of the present invention partly disassembled, FIG. 3 is a lateral sectional view of the present invention showing details thereof, FIG. 4 is a view of part of the present invention showing details of a second embodiment, FIG. 5 is an axial view of a portion of a tunnel constructed in accordance with the second embodiment, FIG. 6 is an elongated cross-section of the present invention showing details thereof, FIG. 7 is a cross-sectional view of one of the ceiling beams of the present invention showing certain additional details, and FIG. 8 is an isometric view of another embodiment of the invention showing a building partly constructed over the tunnel.

Turning first to FIGS. 1A and 1B, a tunnel 1 is shown, constructed in accordance with the prior art by covering a depressed highway 2 along which automobiles 3 pass. A water impervious roof 4 is supported by beams 5 spaced along the highway. While single I-beams have been shown supporting the roof, such beams are sometimes placed two together, or may be prestressed concrete T-beams, box beams, etc. The roof 4 is often poured concrete, concrete slabs, or the like.

In order to accommodate large trees 6 a deep covering of earth 7 covers the roof 4. Unless the earth thickness is deep, the roots of large trees cannot be accommodated. Should only a thin layer of earth be used, only small shrubs or grass may be planted on the surface. In the latter case large expanses of unimpeded space can be generated over which the wind can sweep and which is not entirely aesthetically pleasing. It is aesthetically important to provide parkland with trees, large shrubs, and the like above the tunnel which results in the requirement of a substantial depth of earth.

As automobiles 3 drive along the highway 2, they push air 8 ahead of them as represented by the multiple arc segments, in the direction of the arrows. In addition exhaust fumes accumulate behind the automobiles.

Due to the beams 5, air becomes turbulent and changes direction as shown by the turbulence arrows 9. This substantially increases local pressures and causes high level pockets of exhaust fumes to form within the tunnel. Vertical vents 10 passing through the tunnel ceiling are usually provided to relieve the pressure and to bring in fresh air from outside.

It has been found that due to the turbulence, the number of vents required to relieve the pressure and remove the pockets of exhaust fumes become excessively costly, particularly when auxiliary fans are required.

Boxing in the beams does not remove the difficulty. Installing a false ceiling below the beams 5 increases the laminar flow through the tunnel, but reduces the amount of air within the tunnel. Thus the amount of noxious exhaust fumes per cubic meter of air increases, and the number of vents or the velocity of air required for relief increases.

To provide ventilation in a fully transverse system and to avoid corrosion, double walled concrete structures must be used with auxiliary venting, thus substantially lowering the ceiling, as described earlier.

In order to increase the amount of air in the tunnel with this type of dropped ceiling, the roadway must be cut lower, substantially increasing the cost of the tunnel, and disrupting traffic for extended periods.

FIG. 2 illustrates the partly assembled basic structure of the preferred embodiment of the present invention. Reference is also made to FIG. 3, which is a longitudinal cross-section along the dashed lines X-X of FIG. 2. Roof beams 11 extend across the depressed highway, supported by support structures to be described later.

It should be noted that FIG. 2 illustrates a portion of a divided highway tunnel (e.g. one half, one third, one quarter), accommodating the flow of traffic in one direction; traffic flow in the opposite direction would be covered by a similar structure alongside. Alternatively the structure shown in FIG. 2 can be divided by a longitudinal central divider, or, where a railway, a pedestrian roadway or walkway is to be covered, need not be divided at all. The major objective of the division between the roadways is to separate the air flow directions.

Each roof beam 11 is formed of an elongated slab 12, and a pair of spaced elongated upwardly projecting slab legs 13. The slab legs are spaced from the longer edges 14 of the slab, and extend along the slab preferably from one end to the other. The slabs are spaced apart forming gaps 15 to allow air to flow therethrough.

An elongated closure slab 16 is disposed over the tops of the legs of adjacent slabs along the beams to form vents 17 between adjacent legs of adjacent beams. Only two closure slabs 16 are shown for clarity of illustration in FIG. 2.

The roof beams may alternatively be fabricated from U-shaped beams, having the open portion of the U facing upwardly. The closure slabs 16 are placed over the adjacent legs of adjacent beams as in the previous embodiment. However in this case closure plates or other means can be used to partly cover the gaps between the beams at the bottoms of adjacent legs of adjacent beams, leaving gaps sufficiently open to allow air flow into the space between the legs of adjacent beams, yet forming air vents to conduct air laterally. The vents should not be so large as to introduce turbulence into the tunnel portion.

It may thus be seen that the back of the slab or U-shaped beam which faces into the tunnel forms a smooth ceiling to the tunnel, allowing air to flow smoothly across it along the tunnel. Yet air which is pushed ahead of vehicles enters the gaps 15 between the roof beams, and is conducted along the air vents to the side, to be dealt with as will be described later. Because the gaps 15 occur at very frequent intervals being spaced only the width of a typical beam (e.g. three meters apart), higher pressure air and exhaust gases and fumes are easily collected and can escape the tunnel, without having to be pushed to the end of the tunnel or to infrequently spaced vertical vents having limited inlet area.

The support beams thus themselves form the air vents.

As may be best seen in FIG. 3, earth 18 is deposited over the roof beams. The earth enters the gap between the legs of each beam, and is also built up over the closure slabs 16. It is clear that the depth of the earth between the legs of the roof beams is substantially greater than the depth over the closure slabs. Consequently trees having deep roots can be planted in the earth between the slab legs, and shallower rooting plants such as grass can be planted in the earth over the closure slabs 16. It thus becomes clear how the present invention can provide both a smooth ceiling for the tunnel and the top surface of the earth at a height above the ceiling of the tunnel which is substantially less than that which would be required in the prior art, yet accommodate the roots of tall trees, and at the same time collect a great volume of air for improved ventilation.

It should be noted that the region between the legs of each roof beam can be used to channel rain or irrigation water. With the roof beams being formed preferably out of prestressed concrete, water will naturally be carried along it. However drain tile or gravel 19 can be buried adjacent the upper surfaces of the roof beams to form easy conduction channels for water.

If the climate requires insulation, the entire upper surface of the roof beam 11 and closure slab 16 may be covered by an insulating layer 20, which may be for example polyurethane foam panels preferably formed of or covered by a water impervious layer such as neoprene.

It will also be noted from FIG. 3 that a closure slab 21 may be deposited over the legs of the same roof beam to form an elongated enclosure 22, rather than filling the space with earth. Such an enclosure can be used as an auxiliary air transfer duct, as a utility duct, etc.

FIG. 3 also illustrates the location of a sidewalk 23 which is placed over a gravel base 24 in the earth. The sidewalk can be heated by heat transfer from the duct 22 if desired.

Referring again to FIG. 2, the preferred supporting structure for the roof beams is comprised of elongated U-shaped cross-section support beams 25, having the open part of the U-shape facing upwardly. The support beams are disposed along opposite sides of the depressed highway, the roof beams extending across opposite ones of the support beams to their outer edges. It may thus be seen that the bottom surfaces of the slab 12 form closing surfaces for the beams 25, except where the gaps 15 occur. The ends of the roof beams 10 and the ends of gaps 15 should of course be closed by means of end caps or other tunnel structures (not shown). It may be seen now that the support beams 25 form vents which communicate with vents 17 in the roof beams via gaps 15. Air being driven into the central portions of gaps 15 by the pumping action of traffic or by exhaust fans is thus conducted from vents 17 into the vents formed by support beams 25 and the bottom surfaces of slabs 12.

There are several alternative ways of conducting the air channeled in support beams 25. At appropriate intervals air shafts from the surface can intercept and communicate with the vents formed by support beam 25, thus providing an exhaust. Other vents can pump fresh air into support beams 25. Such structures will be discussed in more detail below.

The support beams 25 are supported by U-shaped cross-section columns 26. Preferably the beams 25 should not abutt, in order that the vents formed thereby may communicate with the interior of columns 26. In order to illustrate the construction, a column 26A is shown unfinished, while a column 26B is shown having an elongated closure member 27 substantially covering the open portion of the beam, the closure member having a grill 28 at its bottom to allow egress of air from its interior. The gaps between the beams 25 may be closed using plates 29.

It may thus be seen that a complete venting system is provided for air pumped by fans or by the piston action of vehicles passing through the tunnel, which enters vents 17 via gaps 15, passes into the vent formed by support beam 25 and the lower surfaces of slab 12. The air can be recirculated by being channelled through vents formed by columns 26 and closure members 27, egressing via grills 28. Alternatively the air in the vent formed by support beam 25 can be exhausted to the outside atmosphere, or fresh air can be conducted in and carried by support beam 25 to column 26, egressing via grills 28 at the vehicle exhaust pipe level. Various ventilating plans can be used, merely by sealing across beams 25 by means of baffles at appropriate places.

In order to provide fresh air or to exhaust polluted air, vertical U-shaped cross-section columns 30 are preferred to be used, spaced along the tunnel at intervals. The closure slab 16 is shortened by the width of the legs of beam 30. Preferably beam 30 is located directly over one of columns 26. Beam 30 is closed using a closure member 31, only a portion of which is shown for clarity. A fan may be used to force fresh air into the vent system down through another column similar to exhaust column 30 while the exhausting air is conducted upwardly through exhaust column 30 by air pressure caused by traffic. Some replacement air can be sucked into the fresh air vent system by means of traffic induced air pressure.

It should be noted that for example the beam 25 and column 26 vent system dividing the highway can be used to distribute fresh air, if beams 25 at the divider are sealed to the gaps 15, and are open only to fresh air inlet column 30, while the beams 11 and 25 vent system at the sides of the highway can be used to exhaust the tunnel if beams 25 at the sides are sealed to column 26 and are open to exhaust column 30.

Banks of lights 32 and/or ceramic tile or other material durable to fumes, fuel and other corrosive materials in automobile exhausts may be located along the walls of the tunnel in order to illuminate the road and seal the tunnel between the two directions of traffic.

Turning now to FIG. 4, another embodiment of the supporting structure is shown. The roof beams 11 and support beams 25 are as illustrated in FIG. 2. However in the embodiment of FIG. 4 the support beams 25 are supported by U-shaped cross-section walkway beams 34 which are disposed in elongated position directly under and supporting support beams 25. Preferably the walkway beams are arched, for strength, and have the open portion of their U cross-section facing downwardly. The height of the legs of walkway beams 34 should be sufficient to allow a workman 35 to be able to pass within the beam. It is preferred that the walkway beams should be illuminated from within, and have exits, at appropriate locations either formed in the leg or legs of the beams 34, or formed by gaps between the ends of the beams.

Supporting walkway beams 34 is a further U-shaped cross-section beam 36 which has the open portion of its U-shape facing downwardly. The further beam 36 is disposed under walkway beam 34 and supports it along its length. At the same time the upper portion of further beam 36 forms a floor for a person walking within between the legs of walkway beam 34. The further beam 36 is supported on a foundation 37 which closes the open side of further beam 36. In this manner another vent running along the depressed highway is formed. Thus the vent formed in the interior of further beam 36 may be used to conduct fresh air through appropriately placed vents located for example at gaps between the ends of further beams 36 into the tunnel at the vehicle exhaust pipe level, while the vents formed interior of the support beams 25 can be used to exhaust air from the tunnel via exhaust columns 30 (shown in FIG. 2). Fresh air can be introduced into beams 36 by an extension of an air inlet beam similar to exhaust column 30. This structure is shown schematically in FIGS. 5 and 6.

FIG. 5 is an axial view of a tunnel formed of an eight lane depressed highway, four lanes in each direction. A supporting structure for the roof beams is shown in accordance with the embodiment of the invention illustrated in FIG. 4. Fresh air, represented by arrows 37, is passed out of the vents formed by further beams 36, which fresh air is introduced via column 30 communicating either directly with further beam 36 or via an intermediate column 26 which is closed to support beam 25.

Polluted air, represented by arrows 38 passes upwardly through gaps 15 (FIG. 6, but not shown in FIG. 5), along the vents formed by roof beams 11, to the vent formed by support beam 25. The air is carried along support beams 25 and passes out of the tunnel via vents formed by exhaust columns 30 (not shown in FIGS. 5 and 6, but as shown in FIG. 2).

Lights 32 to illuminate the tunnel may be mounted on the walls of walkway beams 34 which are interior of the tunnel. This allows servicing of the lights with access by a person within the walkway beam through holes in its legs (walls).

FIG. 7 is a cross-section of a roof beam 11, showing certain additional preferred details thereof. It is preferred that the edge of the upwind beam adjacent each gap should be sloped as shown at 39, in order that the edge of the adjacent beam should form an air scoop in the direction of on-coming traffic. This will more efficiently bring air forced ahead of the automobile traffic into the gaps 15 and the air vents 17.

As noted earlier it is preferred that the beams should be formed of prestressed concrete. It is of course desirable that they should be treated in a manner known in the art to reject pollutants both from exhaust chemicals within the tunnel (such as by coating the lower surface with epoxy) and from constituents and compounds formed of the earth above which may come into contact with the beams (such as by coating the upper surface with neoprene). It is also preferred to insert vibration pads between the roof beams and support beams and/or between the support beams 25 and vertical columns 26.

FIG. 7 also illustrates an auxiliary structure enhancing the utility of the invention. A precast railing support structure 40 is disposed with a support block portion 41 lying over and in contact with the upper edge of one of the legs of roof beam 11, and being connected to an anchor portion 42 which both bears against an edge of roof beam 11 for stability, and is buried under the earth. The anchor portion, bearing against the edge of the roof beam, and being buried, forms support against lateral movement of the railing support structure or rotation of the support block 41. A railing 43 extends upwardly from the support block 41 above the earth grade level. The anchor portion 42 may, of course, be formed so that bears against another portion of the roof beam 11.

Accordingly the railing which protrudes above the grade level of the earth 7 is firmly supported and anchored by the structure.

FIG. 8 depicts the structure of a partial skeleton of a multi-storey building being built above the tunnel described above, shown partly assembled for clarity. The columns 50 adjoin the columns 26 whereby the weight of the building may be transmitted directly to a foundation 37 under columns 26. The bottom floor of the building may be directly supported by the closure slabs 16 if desired. Prestressed concrete floor slabs may be laid directly over the closure slabs 16, and indeed may form the closure slabs themselves. These floor slabs may be used as the floor of a garage for the building for example.

The columns 50 can be formed either out of solid square or rectangular cross-section concrete beams or, preferably, U-shaped beams. Ledges 51 cast to the sides of the columns support horizontal beams 52, some of which are shown in place. Prestressed concrete floor slabs (not shown) may be supported by horizontal beams 52. The remainder of the building structure will be evident from the above.

The junctions of columns 50 with columns 26 are preferred to be made through the floor of horizontal beams 25 or alternatively directly via cut-outs in support beams 25. Air flow may be continued from one support beam 25 to an adjacent support beam 25 through column 50 via holes cast in column 50.

The roof beams 11 for the tunnel extend over the length of the tunnel both under the building and beyond. Only a few roof beams are shown for the sake of clarity.

U-shaped columns 50 are preferred to be used so that utilities can be routed through them, which utilities can pass through to horizontal beams 52 if beams 52 are also made U-shaped. The open side of the "U" can of course be cosmetically closed.

The building structure can extend laterally past the tunnel structure and the structure beside the tunnel can be supported by conventional footings.

In the above manner a depressed or surface highway can be covered to form a tunnel, provide treed parkland and easy crossing access for pedestrians from one side to the other. At the same time valuable commercial buildings may be built over the tunnel using many of the structural members of the tunnel as part of or to support the building above. Thus previously unusable space may be put to commercial use without having to build large and unusual cantilevered structures or long bridge structures over the highway to support the building.

It should be understood that since prestressed prefabricated concrete structural members are the preferred major construction elements in this invention, all elements can be erected by means of cranes, and neither scaffolding nor concrete forms are required. This allows the highway to be used during the construction period and also reduces construction cost.

A person skilled in the art understanding this invention may now conceive of various variations and other embodiments. For example, where strength allows it the slab roof beam 12 may be made without upwardly extending legs. Instead an elongated U-shaped structure may be placed with its open side down straddling the gap between adjacent slabs to form the vent.

Further gapped plates made of prestressed concrete or of a corrosion resistant material such as stainless steel may extend across the gaps between the beams to define the gaps.

Air scoops adjacent the gaps can also be fastened to the downwind beams to bring air into the gaps and therefore into the vents.

Pairs of horizontally disposed legs held in position by braces could also be used, covered by a top cover, whereby the vent above each gap 50 can be formed.

Other variations and embodiments may come to mind according to a particular design requirement. All such variations are considered to be within the scope of the present invention as defined in the claims appended hereto.

I claim:

1. A tunnel structure comprising support structures for roof beams, and a plurality of parallel roof beams supported by said support structures extending laterally over a highway, each of said roof beams being comprised of an elongated slab and a pair of spaced elongated upwardly projecting slab legs each spaced from longer edges of the slab and extending along said slab, the slabs being spaced apart a distance sufficient to allow air flow therebetween, and elongated closure slabs each disposed over the ends of the legs of adjacent slabs along said beams to form vents between adjacent legs of adjacent beams.

2. A tunnel structure comprising support structures for roof beams, and a plurality of parallel roof beams supported by said support structures extending laterally over a highway, each of said roof beams being comprised of an elongated U-shaped cross-section beam having the open part of the U-shape facing upwardly, the beams being laterally spaced apart, a closure slab extending across the tops of and along the legs of adjacent legs of adjacent beams, and means partly closing gaps between the beams at the bottoms of the legs but being sufficiently open to allow air flow into the space between the legs of adjacent beams.

3. A tunnel as defined in claim 2 in which the partly closing means is comprised of extension means from a back portion of one or both beams closing a portion of said gaps.

4. A tunnel as defined in claim 2 in which the partly closing means is comprised of gapped plates extending across the gaps between said beams.

5. A tunnel as defined in claim 2 in which each of the beams and partly closing means is formed together of prestressed concrete.

6. A tunnel as defined in claim 2, 3 or 4 in which the support structures are located along the edges and/or traffic divider of a tunnel and the beams are disposed laterally across the tunnel and are supported at their ends by the support structures.

7. A tunnel as defined in claim 2, 3 or 4 in which the support structures are located along the edges and/or traffic divider of a tunnel and the beams are disposed laterally across the tunnel and are supported at their ends by the support structures, the support structures being formed of U shaped cross-section support beams having the open side of the U facing upwardly, extending along the edges and/or traffic divider of the tunnel, whereby the open part of the space between the legs of adjacent roof beams communicate with the interior of the U of the support beams to form lateral vents connected to longitudinal vents.

8. A tunnel as defined in claim 2, 3 or 4 in which the support structures are located along the edges and/or traffic divider of a tunnel and the beams are disposed laterally across the tunnel and are supported at their ends by the support structures, the support structures being formed of U shaped cross-section support beams having the open side of the U facing upwardly, extending along the edges and/or traffic divider of the tunnel, whereby the open part of the space between the legs of adjacent roof beams communicate with the interior of the U of the support beams to form lateral vents and longitudinal vents, the support structure further including vertical U shaped cross-section columns supporting ends of adjacent ones of the support beams, the support beams being spaced whereby the interior of the support beams communicates with the interior of the columns, the columns having the open side of the U partly closed whereby air flow can be conducted therealong and allowed to exit into the tunnel.

9. A tunnel as defined in claim 2, 3 or 4 in which the support structures are located along the edges and/or traffic divider of a tunnel and the beams are disposed laterally across the tunnel and are supported at their ends by the support structures, the support structures being formed of U shaped cross-section support beams having the open side of the U facing upwardly, extending along the edges and/or traffic divider of the tunnel, whereby the open part of the space between the legs of adjacent roof beams communicate with the interior of the U of the support beams to form lateral vents and longitudinal vents, the support structure further including vertical U shaped cross-section columns supporting ends of adjacent ones of the support beams, the support beams being spaced whereby the interior of the support beams communicate with the interior of the columns, the columns having the open side of the U partly closed whereby air flow can be conducted therealong and allowed to exit into the tunnel, and additional vents communicating between outside air above the roof beams and the interior of the support beams.

10. A tunnel as defined in claim 2, 3 or 4, further including soil filling the space between the legs of each of the roof beams and covering the elongated closure slabs whereby water can be channeled between the legs of each of the roof beams and the roots of large plants can grow in the soil between said legs.

11. A tunnel as defined in claim 2, 3 or 4, further including drainage tile or gravel covering the bottom of the space between the legs of each roof beam, and soil filling the space between the legs of each of the roof beams and covering the elongated closure slabs whereby water can be channeled between the legs of each of the roof beams and the roots of large plants can grow in the soil between said legs.

12. A tunnel as defined in claim 2, 3 or 4 in which the support structures are located along the edges and/or traffic divider of a tunnel and the beams are disposed laterally across the tunnel and are supported at their ends by the support structures, the support structures being formed of U shaped cross-section support beams having the open side of the U facing upwardly, extending along the edges of the tunnel, whereby the open part of the space between the legs of adjacent roof beams communicate with the interior of the U of the support beams to form lateral vents and longitudinal vents, the support structure further including U shaped cross-section walkway beams extending under and supporting at least part of the support beams, the legs of the walkway beams extending downward and having an interior height sufficient to allow a person to pass.

13. A tunnel as defined in claim 2, 3 or 4 in which the support structures are located along the edges and/or traffic divider of a tunnel and the beams are disposed laterally across the tunnel and are supported at their ends by the support structures, the support structures being formed of U shaped cross-section support beams having the open side of the U facing upwardly, extending along the edges and/or traffic divier of the tunnel, whereby the open part of the space between the legs of adjacent roof beams communicate with the interior of the U of the support beams to form lateral vents and elongated vents, the support structure further including U shaped cross-section walkway beams extending under and supporting at least part of the support beams, the legs of the walkway beams extending downward and having an interior height sufficient to allow a person to pass, the walkway beams containing lights for illuminating the tunnel outside at least one leg.

14. A tunnel as defined in claim 2, 3 or 4 in which the support structures are located along the edges and/or traffic divider of a tunnel and the beams are disposed laterally across the tunnel and are supported at their ends by the support structures, the support structures being formed of U shaped cross-section support beams having the open side of the U facing upwardly, extending along the edges and/or traffic divider of the tunnel, whereby the open part of the space between the legs of adjacent roof beams communicates with the interior of the U of the support beams to form lateral vents and longitudinal vents, the support structure further including U shaped cross-section walkway beams extending under and supporting at least part of the support beams, the legs of the walkway beams extending downward and having an interior height sufficient to allow a person to pass, the support structure comprising U shaped cross-section further beams supporting the walkway beams having the open side of the U downward facing to the floor of the tunnel thereby forming a horizontal vent, the top of the further beams forming a floor for the walkway beams.

15. A tunnel as defined in claim 2, 3 or 4 in which the support structures are located along the edges and/or traffic divider of a tunnel and the beams are disposed laterally across the tunnel and are supported at their ends by the support structures, the support structures being formed of U shaped cross-section support beams having the open side of the U facing upwardly, extending along the edges and/or traffic divider of the tunnel, whereby the open part of the space between the legs of adjacent roof beams communicate with the interior of the U of the support beams to form lateral vents and longitudinal vents, the support structure further including vertical U shaped cross-section columns supporting ends of adjacent ones of the support beams, the support beams being spaced whereby the interior of the support beams communicate with the interior of the vertical columns, the vertical columns having the open side of the U partly closed whereby air flow can be conducted therealong and allowed to exit into the tunnel, and a building structure located above the tunnel having support columns supported by said vertical columns.

16. A tunnel as defined in claim 2, 3 or 4 in which the support structures are located along the edges and/or traffic divider of a tunnel and the beams are disposed laterally across the tunnel and are supported at their ends by the support structures, the support structures being formed of U shaped cross-section support beams having the open side of the U facing upwardly, extending along the edges and/or traffic divider of the tunnel, whereby the open part of the space between the legs of adjacent roof beams communicate with the interior of the U of the support beams to form lateral vents and longitudinal vents, the support structure further including vertical U shaped cross-section columns supporting ends of adjacent ones of the support beams, the support beams being spaced whereby the interior of the support beams communicate with the interior of the vertical columns, the vertical columns having the open side of the U partly closed whereby air flow can be conducted therealong and allowed to exit into the tunnel, U shaped building frame columns extending upwardly from and being supported by said vertical columns, and lateral building frame beams supported from the building frame columns for supporting floors of a building above the tunnel.

17. A tunnel as defined in claim 2, 3 or 4 in which the edges of the partly closing means upwind of the gaps are chamfered upwardly to form an air scoop with the adjacent edge of the partly closing means downwind of the gaps.

18. A tunnel structure comprising support structures for a tunnel roof on opposite sides of a highway passing through the tunnel, said roof being formed of a plurality of elongated parallel disposed slabs supported by the support structure and extending laterally over a highway, the slabs being spaced so as to form gaps therebetween, an elongated housing disposed over each of said gaps to form a plurality of vents above said slabs, and means communicating with said vents to exhaust air therefrom.

19. A tunnel structure as defined in claim 18 in which each of said elongated housings is comprised of a pair of legs extending upwardly from adjacent slabs to form vent sides, and a top closure means covering the tops of the legs.

20. A tunnel structure as defined in claim 18 in which each of said elongated housings is U-shaped in cross-section and has the open side of its U-shape disposed on the top surface of adjacent elongated slabs, straddling one of said gaps.

* * * * *